United States Patent [19]

Goldowsky et al.

[11] Patent Number: 4,995,744

[45] Date of Patent: Feb. 26, 1991

[54] IMPACT PRINTER ACTUATOR USING MAGNET AND ELECTROMAGNETIC COIL AND METHOD OF MANUFACTURE

[75] Inventors: Michael P. Goldowsky, Valhalla, N.Y.; Teiji Hisano, Fujisawa, Japan; John P. Karidis, Ossining, N.Y.; Hiromi Shibuya, Fujisawa; Osamu Ueda, Yokohama, both of Japan

[73] Assignee: International Business Machines Corporation, Armonk, N.Y.

[21] Appl. No.: 285,203

[22] Filed: Dec. 16, 1988

[51] Int. Cl.[5] ..... B41J 2/28

[52] U.S. Cl. ..... 400/157.2; 400/124; 101/93.05; 101/93.29; 335/229; 29/607

[58] Field of Search ..... 400/121, 124, 157.2; 101/93.01, 93.04, 93.05, 93.29, 93.48; 335/230, 234, 229; 29/602.1, 606, 607

[56] References Cited

U.S. PATENT DOCUMENTS

| | | | |
|---|---|---|---|
| 3,089,064 | 5/1963 | Cotton de Bennetot | 335/229 |
| 3,470,510 | 9/1969 | Richert | 335/230 |
| 3,609,608 | 9/1971 | Pokorny | 335/230 |
| 3,672,482 | 6/1972 | Brumbaugh | 197/1 R |
| 3,707,122 | 12/1972 | Cargill | 101/93.09 X |
| 3,906,854 | 9/1975 | Gomi | 335/230 X |
| 4,015,174 | 3/1977 | Cotton de Bennetot | 335/234 X |
| 4,160,965 | 7/1979 | Kobler | 335/230 X |
| 4,258,623 | 3/1981 | Barrus | 101/93.04 |
| 4,302,115 | 11/1981 | Yasunaga et al. | 400/124 |
| 4,306,207 | 12/1981 | Tada | 335/234 |
| 4,383,234 | 5/1983 | Yatsushiro | 335/230 X |
| 4,537,520 | 8/1985 | Ochiai et al. | 400/124 |
| 4,582,437 | 4/1986 | Wang | 400/124 |
| 4,609,899 | 9/1986 | Koehler | 335/230 |
| 4,681,467 | 7/1987 | Karidis | 400/124 |

FOREIGN PATENT DOCUMENTS

| | | | |
|---|---|---|---|
| 27376 | 3/1981 | Japan | 101/93.04 |
| 110263 | 6/1983 | Japan | 400/124 |
| 112756 | 7/1983 | Japan | 400/124 |
| 60-48371 | 3/1985 | Japan . | |
| 37443 | 2/1986 | Japan | 400/124 |
| 179759 | 8/1986 | Japan | 400/124 |

OTHER PUBLICATIONS

Bateson, J. E. et al., "Print Hammer Mechanism", IBM Technical Disclosure Bulletin, vol. 22, No. 8B, Jan. 1980, pp. 3536-3537.

Hasler, W., et al., "Print Hammer", IBM Technical Disclosure Bulletin, vol. 25, No. 9, Feb. 1983, pp. 4901-4902.

Skinner, D. W.; "No-Work Print Hammer"; *IBM Technical Disclosure Bulletin;* vol. 21, No. 11, pp. 4452-4453; Apr. 1979.

Barcomb, J. G. et al.; "Print Hammer Flight Time Variation Control"; *IBM Technical Disclosure Bulletin;* vol. 22, No. 8A, pp. 3171-3172; Jan. 1980.

Cross R. G. et al.; "Print Wire Actuator . . . "; *IBM Technical Disclosure Bulletin;* vol. 23, No. 5, pp. 1765-1766; Oct. 1980.

Helsinki, E. F.; "Technique for Operating A Moving Coil Print Hammer"; *IBM Technical Disclosure Bulletin;* p. 3672; vol. 22, No. 8B; Jan. 1980.

*Primary Examiner*—David A. Wiecking

*Attorney, Agent, or Firm*—Perman & Green

[57] ABSTRACT

A print actuator for a dot matrix printer has a stator with a frame, at least two ferromagnetic poles and at least one permanent magnet; and at least one electromagnetic coil surrounding the magnet. The magnet can generally hold an armature in a home position by its magnetic flux until the coil is energized at which point the magnetic flux of the magnet is neutralized by the magnetic flux of the coil and the armature is substantially released of influence from the magnet's hold.

19 Claims, 5 Drawing Sheets

IMPACT PRINTER ACTUATOR USING MAGNET AND ELECTROMAGNETIC COIL AND METHOD OF MANUFACTURE

BACKGROUND OF THE INVENTION

1. Field of the Invention

The present invention relates to impact printer actuators and, more particularly, to a compact print actuator having a permanent magnet, an electromagnetic coil and light weight armatures mounted along gaps between poles of a stator to complete transverse flux paths and the method of manufacturing the same.

2. Prior Art

The art is replete with electromagnetic print actuator devices. Such devices seek to achieve high speeds and greater print density using a variety of actuator configurations. Wire matrix printers, in particular, seek to increase print density by decreasing the distance between adjacent actuator wires. Consequently, a standing requirement in this field is to reduce overall actuator size. U.S. Pat. No. 3,138,427 describes a facsimile system utilizing a transducer assembly comprising an armature, coil and a core comprising leg elements. A marking member is clamped to one leg. The amount of pressure exerted by the forward longitudinal edge of the marking element is a function of the energization of the winding from the source.

A moving coil assembly, as illustrated in U.S. Pat. No. 3,780,650, employs a coil with pole pieces positioned between pole plates. The magnetic reluctance is reduced by having the pole pieces arranged with the air gaps parallel to each other. IBM Technical Disclosure Bulletin, Volume 21, Number 11, pp. 4452–4453 (April 1979) discloses a print hammer assembly employing a bank of print hammers individually supported on a base by means of a cantilever arrangement. Armature poles have coils wound in series of bobbins placed over the armature poles. The flux path is minimized due to the series winding of the coils and is disposed in a longitude direction aligned with the direction of movement of the spring hammer elements. A variation of this mechanism is shown in IBM Technical Disclosure Bulletin, Volume 25, Number 9, pp. 4901–4902 (February 1983). The actuator disclosed therein employs a print hammer cantilever-mounted on a magnet yoke carrying an energizing coil, a spherical stop and a rest stop. The rest stop includes a permanent magnet for biasing the print hammer into a rest position. Upon energization of the coil, the armature flexes, deflecting the hammer element about the spherical stop which acts as a fulcrum. Another example of a print hammer mechanism employing a pivoting print finger is illustrated in IBM Technical Disclosure Bulletin, Volume 22, Number 8B, pp. 3536–3537 (January 1980). The actuator therein employs a holding magnet and a separate coil for purposes of releasing the print finger from its retaining structure.

A somewhat different arrangement is illustrated in IBM Technical Disclosure Bulletin, Volume 23, Number 5, pp. 1765–1766 (October 1980). Print wires are driven by piston and held in a home position by means of a magnetic circuit including housings and a permanent magnet. A coil bobbin assembly having magnetic return elements is offset relative to the travel of the print wire. The magnetic flux path acts in a direction aligned with the travel of the print wire.

Other art considered, but deemed less germane to this invention, is disclosed in IBM Technical Disclosure Bulletin, Volume 22, Number 8A, pp. 3171–3172 (January 1980) and Volume 22, Number 8B, pp, 3672 (January 1980). Those disclosures relate to electronic techniques for flight time control of print hammers. Also considered, solely for purposes of the magnetic circuit, is the U.S. Pat. No. 2,202,729, which discloses a coil, armature and pole pieces. The relay disclosed in that patent is not considered pertinent to a print hammer assembly.

U.S. Pat. No. 4,681,467 by Karidis discloses a print actuator for dot matrix applications having a stator with a coil wrapped thereon and constrained by the walls of the stator. This reference does not use a permanent magnet, but rather, uses only a coil to allow for more compact packaging. However, it does have a disadvantage by requiring power to be dissipated in the print head even when it is not printing. This problem was identified in the patent itself and described as being controlled by retracting the printhead or platen thereby allowing the armatures to be released without marking the paper when the printer is not receiving any data. However, this type of controlling of the armatures requires additional parts for the printer and increases the cost for the printer.

Given the deficiencies in the prior art, it is an object of the present invention to provide a print actuator that not only allows for more compact packaging, but also can operate with reduced power consumption when the printhead is not printing.

It is a further object of the present invention to provide a print actuator that will not inadvertently print if there is a sudden inadvertent loss in power to the print actuator.

It is a further objective of the present invention to define an easily-manufacturable, high-density printhead-assembly for use in wire matrix printers.

It is a further objective of the present invention to provide a print-hammer actuator assembly that employs a stator having, for each actuator, a transverse permanent magnet magnetic flux path and an electromagnetic coil that can neutralize the permanent magnet magnetic flux. By employing a transverse magnetic flux path, individual flux paths may be neutralized when isolated coils are selected.

It is a further objective of the present invention to provide a print hammer actuator that employs a stator assembly wherein permanent magnet magnetic flux paths for adjacent actuators have opposing polarities in the stator and transverse magnetic flux paths across the armatures.

Another object of this invention is to provide an armature rest with a profile which configures the armature for optimum dynamics upon actuation.

SUMMARY OF THE INVENTION

The foregoing problems are overcome and other advantages are provided by an actuator for use in a dot matrix printer having a permanent magnet and an electromagnetic coil arranged with generally opposite, but approximately equal magnetic flux.

In accordance with one embodiment of the invention, an actuator is provided comprising stator means and coil means. The stator means comprises a stator frame having at least two ferromagnetic poles and at least one permanent magnet. The magnet separates the poles and is magnetized in a line along an axis of the stator means. The poles have ends which extend from the axis and beyond the magnet. The coil means comprises at least one electromagnetic coil having an axis parallel to the stator means axis and substantially surrounding the magnet with at least a portion of the coil being located between the poles whereby the magnet can produce a magnetic flux through the poles to hold an armature and the coil can be energized to cancel the magnetic flux from the magnet such that the armature can move.

In accordance with another embodiment of the invention, a print actuator is provided comprising stator means, magnet means, coil means, armature means and biasing means. The stator means is made of ferromagnetic material and has a plurality of extending poles along an axis of the stator means and forms coil channels between each of the poles. The magnet means comprises a plurality of permanent magnets, each of the magnets disposed in the stator means along the stator means axis proximate the coil channels and being magnetized along the path of the stator means axis. The magnets being reversed in polarity relative to adjacent magnets. The coil means comprises a plurality of electromagnetic coils, each of the coils having an axis parallel to the stator means axis and substantially surrounding one of the permanent magnets with at least a portion of each of the coils in one of the coil channels between a pair of the poles. The armature means comprises a plurality of armatures disposed substantially perpendicular to the stator means axis and each of the armatures extending across one of the coil chambers. The biasing means can bias the armatures away from the poles. Wherein magnetic flux paths from the magnet means extend through alternate poles of the stator means, transversely through the width of each of the armatures in directions parallel to the stator means axis, and through the other of the alternating poles to hold the armatures in a first position proximate the poles and whereby the coils can be selectively energized to neutralize selective permanent magnet flux paths and allow the biasing means to urge selected armatures into printing engagement.

In accordance with one method of the invention, a method of manufacturing a dot matrix printer actuator is provided comprising the steps of providing a ferromagnetic stator having an axis, the stator having a base and a plurality of poles arranged in a line along the stator axis; inserting and bonding permanent magnets into first slots in the stator, the first slots each being arranged between pairs of adjacent poles; and installing coils around the permanent magnets and in second slots between adjacent poles.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
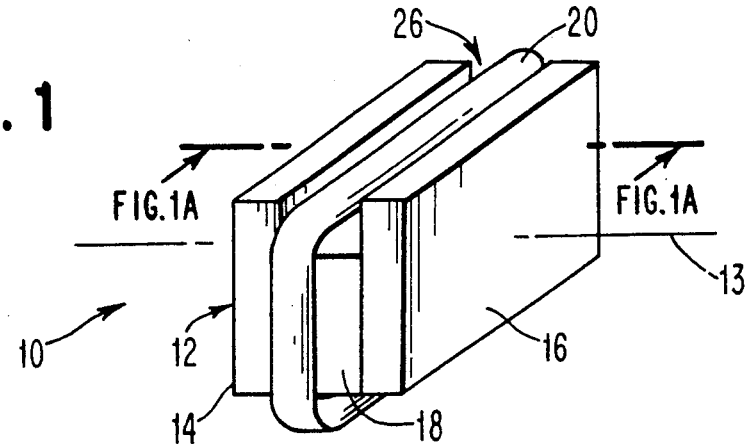
FIG. 1 is a perspective view of one embodiment of the invention.
Figure 1A:
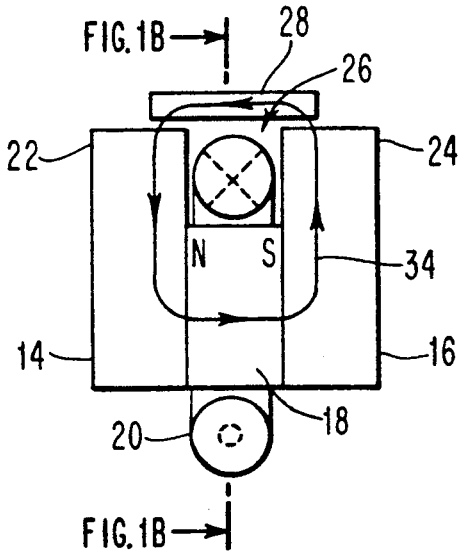
FIG. 1A is a schematic cross-sectional view of the armature shown in FIG. 1 taken along lines A—A.
Figure 1B:
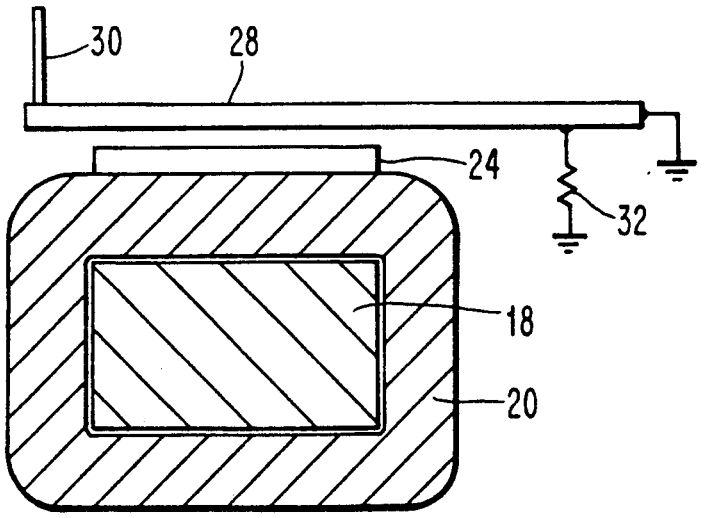
FIG. 1B is a schematic cross-sectional view of the armature shown in FIG. 1A taken along lines B—B.

Referring to FIGS. 1, 1*a*, and 1*b* there are shown schematic views of one embodiment of the present invention. An actuator 10, in this embodiment, comprises a stator 12 having a first pole 14, a second pole 16, a permanent magnet 18, and an electromagnetic coil 20. The stator 12 generally comprises an axis 13 indicated by the center line in FIG. 1. In the embodiments shown, the two poles 14, 16 and the magnet 18 are aligned along the stator axis 13 forming a sandwich with the magnet 18 being located between the two poles 14, 16. The two poles 14, 16 are generally comprised of any suitable ferromagnetic material. The poles 14, 16 each comprise an extending end 22, 24 which extends transversely from the stator axis above the top portion of the magnet 18 and thereby forms a channel 26 with the top of the magnet forming the base of the channel and the extending portions 22, 24 of the poles 14, 16 forming the sides of the channel 26. In the embodiment shown, the magnet 18 is fixedly bonded to the two poles 14, 16.

The magnet 18 is intended to be a permanent magnet and can be made from any suitable material. However, in a preferred embodiment, the magnet is formed from samarium-cobalt. The magnet 18 is arranged relative to the poles 14, 16 such that a north pole of the magnet is located adjacent one of the poles and the south pole is located adjacent the opposite pole. The coil 20 is an electromagnetic coil and generally surrounds the magnet 18 with a top portion of the coil being located in the channel 26 with the ends 22, 24 of the poles extending past the top of the coil 20. The coil 20 generally comprises a coil axis and in this embodiment the coil axis is the same as the stator axis 13. However, the coil axis need not be the same as the stator axis 13, but rather, it may merely be parallel to the stator axis. Referring now particularly to FIGS. 1*a* and 1*b* there is shown the actuator of FIG. 1 with an armature 28. The armature 28 generally comprises a printing pin 30 and is biased away from the actuator 10 by a suitable spring means 32. In a preferred embodiment, an external spring means is not provided. Rather, the internal strain energy, provided by the armature 28 being bent, provides a force for biasing the armature 28 away from the poles. The actuator of the present invention generally allows for the armature 28 to be in either one of two positions; a printing position or a non-printing position. The non-printing position of the armature 28 generally consists of the coil 20 not being energized such that the magnet 18 uses the poles 16, 14 and produces an electromagnetic flux path through the pole 16 up to and through the armature 28 and down back towards the magnet 18 by the pole 14. This magnetic flux is sufficiently strong to overcome the biasing of the spring means 32 such that the armature 28 is held against the extending portions 22, 24 of the poles 14, 16. In order to activate the armature 28 such that the printing pin 30 can print, the electromagnetic coil 20 is energized. In the embodiment shown in FIG. 1*a*, because the north pole is located adjacent the first pole 14 and the south pole of the magnet 18 is located adjacent the second pole 16, the direction of the current running through the coil 20 is shown in dashed lines. In the event that the magnet 18 had opposite poles then the direction of the current in the coil 20 could quite obviously be reversed as will be seen below. The energizing of the coil 20 generally produces electromagnetic flux which is generally equal but opposite to the magnetic field of the permanent magnet 18. Thus the coil 20 substantially cancels or counteracts the magnetic field of the magnet 18 which was holding the armature 28. Since the armature 28 is no longer being held by the magnetic field of the permanent magnet 18, the spring means 32 and the stored energy in the armature 28 causes the armature 28 to accelerate away from the stator 10 converting strain energy previously stored in the armature 28 into kinetic energy used for printing. Upon completion of the printing process the coil 20 is denergized and the magnetic flux of the permanent magnet 18 is able to once again magnetically take hold of the armature 28 and hold the armature 28 in a non-printing position against the poles 14, 16. Alternatively, the direction of the current in the coil 20 may be reversed to temporarily attract the armature 28 towards the magnet 18 such that the magnet 18 can get a firm magnet hold on the armature 28.

Figure 2:
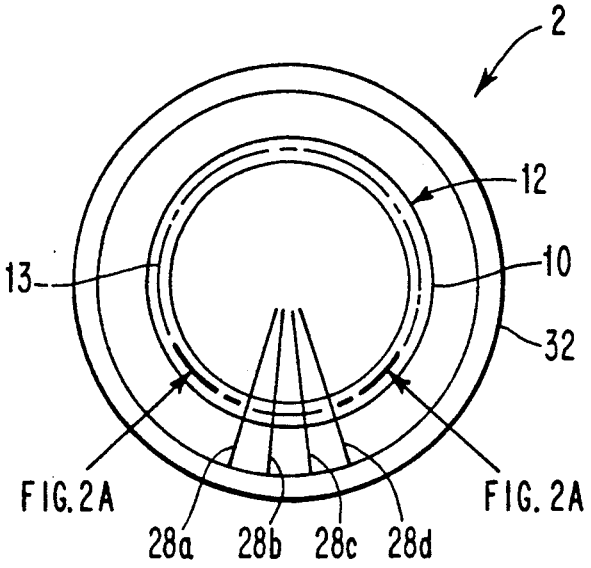
FIG. 2 is a partial schematic view of a print head for a dot matrix printer.
Figure 2A:
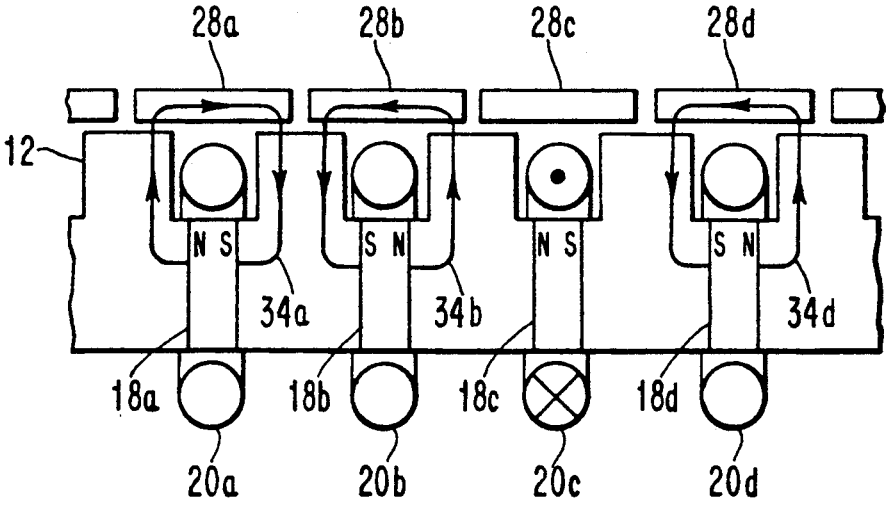
FIG. 2A is a partial schematic cross-sectional view of the armature of FIG. 2 taken along lines A—A.

Referring now to FIG. 2 there is shown a partial schematic view of a circular arrangement of a printhead in a conventional dot matrix printer. In the embodiment shown, the stator frame 12 is provided with a circular central axis 13 and the armatures 28*a*, 28*b*, 28*c* and 28*d* are connected to the biasing means 32 such that the armatures can lie over the top of the stator frame 12. FIG. 2*a* shows a partial schematic cross sectional view taken along line A—A of FIG. 2. In the embodiment shown , the actuator 10 comprises a plurality of permanent magnets 18*a*, 18*b*, 18*c*, and 18*d* arranged in alternating polarity with adjacent permanent magnets. The magnetic flux 34 from each of the permanent magnets 18 is shown as traveling up one pole through an armature 28 and back down through another pole. Thus, each of the permanent magnets 18*a*, 18*b*, 18*c*, 18*d*, is able to hold its associated armature 28*a*, 28*b*, 28*c*, 28*d*. As shown in this embodiment, with one of the coils 20*c* energized, the magnetic flux of an associated permanent magnet 18*c* is cancelled by the opposite but substantially equal magnetic field established by the coil 20*c* without significantly disturbing adjacent armatures. Thus, the armature 28*c* associated with the coil 20*c* which is energized is substantially free of the magnetic hold of the permanent magnet 18*c* and, due to the armature's 28*c* stored energy and the spring means 32, the armature 28*c* can advance into printing engagement with the object to be printed upon.

Figure 3:
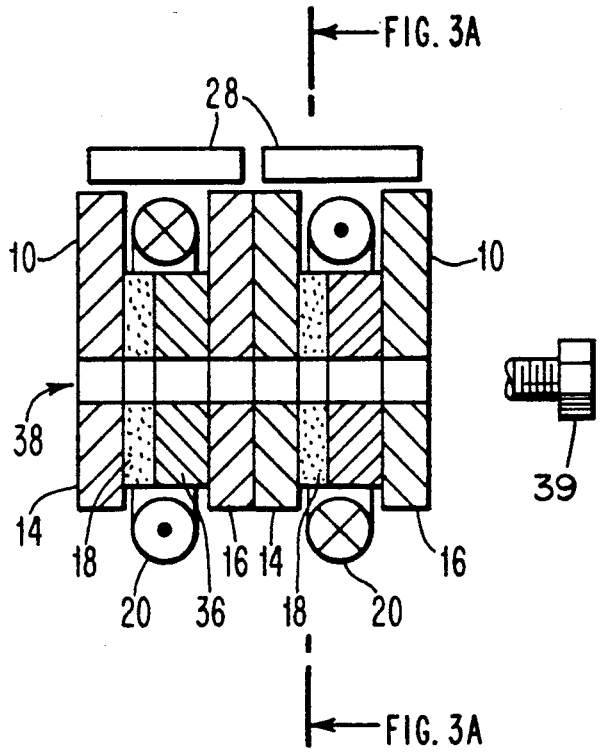
FIG. 3 is a cross-sectional view of an alternate embodiment of the invention.
Figure 3A:
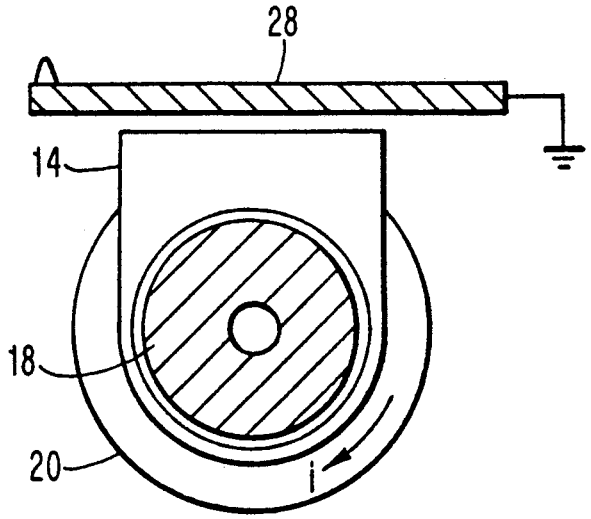
FIG. 3A is a cross-sectional view of the armature shown in FIG. 3 taken along line A—A.

Referring now to FIGS. 3 and 3*a* an alternate embodiment of the invention is shown. In the embodiment shown, separate individual stator modules 10 are provided for each armature 28 position. Each stator module 10 comprises a thin permanent magnet 18, a ferromagnetic slug or offset yoke 36, an electromagnetic coil 20 which surrounds the magnet and the offset yoke and two pole plates 14, 16 which confine the coil 20 and provide the flux path from the permanent magnet 18 up to the armature 28. In practice, the stator modules 10 would be manufactured individually in large quantities and then attached together in groups of arbitrary length by utilizing one or more pins which pass through the center 38 of module 10, or by using any suitable attachment means such as bolt 39.

Figure 4:
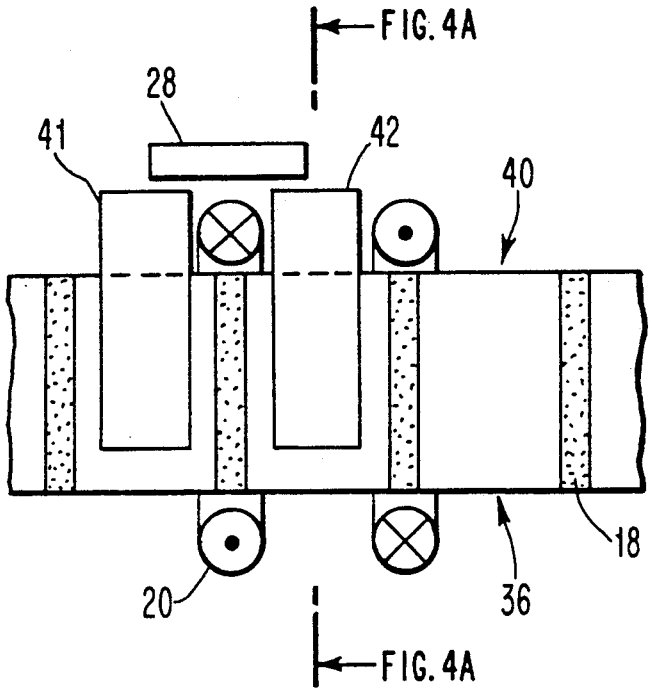
FIG. 4 is a partial schematic cross-sectional view of an alternate embodiment of the invention.
Figure 4A:
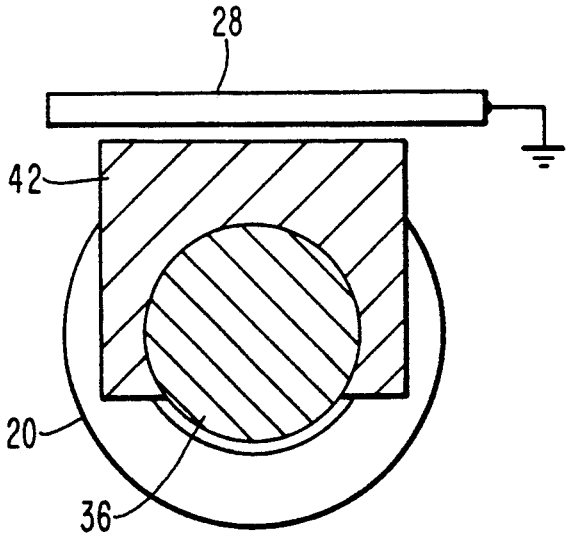
FIG. 4A is a cross-sectional view of the embodiment of FIG. 4 taken along lines A—A.

Referring now to FIGS. 4 and 4*a*, there is shown a schematic view of an alternate embodiment of the invention. In the embodiment shown, a long round bar 40 is assembled by bonding alternating layers of permanent magnets 18 and ferromagnetic slugs 36 of the same outside dimensions. After the bar 40 is assembled to the length required for one stator assembly, an appropriate number of pole plates 41, 42 and coils 20 are then held in their proper axial positions by a precision fixture and bonded in place thereby completing the armature assembly. An alternate approach may utilize wound in place coils which would be added after the stator was completed. The embodiment shown in FIGS. 4 and *4a* has a distinct advantage of allowing small dimensional errors in thickness of the magnets and the associated slugs since the final position of the pole plates, which is the critical parameter of the assembly, is determined by a fixturing process.

Figure 5:
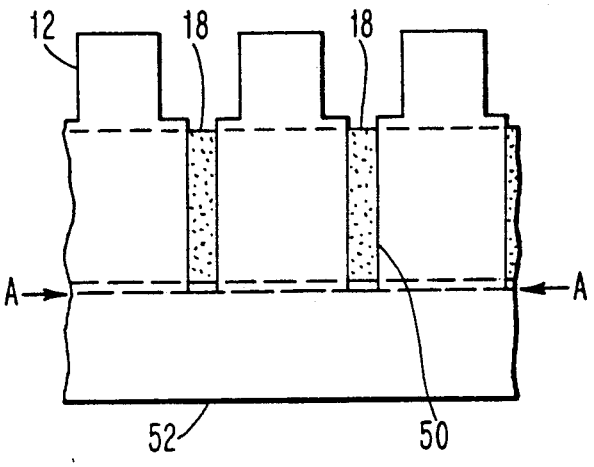
FIG. 5 is a partial schematic view of laminated plates and magnets during the manufacture of an alternate embodiment of the invention.
Figure 5A:
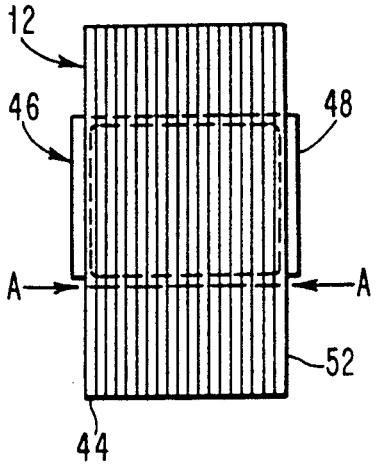
FIG. 5A is an end view of the plates and magnets of FIG. 5 with support plates attached.
Figure 5B:
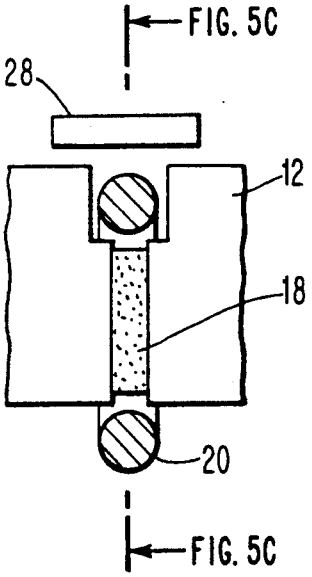
FIG. 5B is a partial schematic cross-sectional view of the finished alternate embodiment of FIGS. 5 and 5A.
Figure 5C:
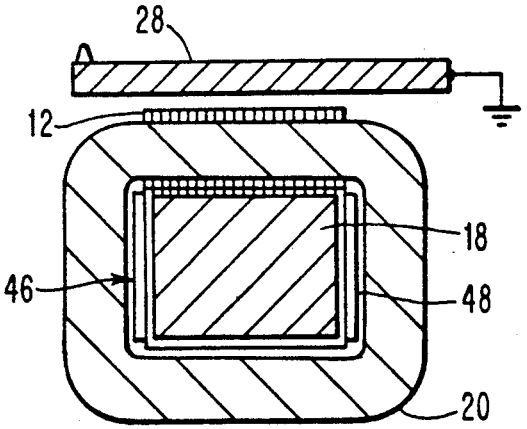
FIG. 5C is a cross-sectional view of the embodiment shown in FIG. 5B taken along lines C—C.

Referring now to FIGS. 5 and 5*a*, there is shown an alternate embodiment of the invention designed to minimize eddy currents and tolerance issues. In the embodiment shown, a stator frame 12 is provided comprising laminated plates 44 made of a material such as iron. Generally, the plates 44 are bonded together to form a stack of desired thickness. At the same time, or in a subsequent step desired, relatively thin permanent magnets 18 are bonded into appropriate slots 50 in the stator frame 12 and two additional non-magnetic support plates 46 and 48 would be bonded onto the front and back of the laminated stack as shown. The support plates must be non-magnetic to avoid creating an undesirable shunt path for the permanent magnet flux. After the entire assembly of iron laminations, permanent magnets, and non-magnetic support plates are cured, the entire continuous section 52 of the iron laminations 44 would be cut off in a final machining operation along line A—A, leaving the support plates 46, 48 to provide the final structure and dimensional integrity for the stator assembly as shown in FIGS. 5*b* and 5*c*. Finally, coils would either be wound in place around each of the magnets, or slip on type coils would be installed. This laminated design improves actuator performance by reducing eddy currents and eliminates several tolerance stack-up issues. It also requires the use of rectangular magnet sections which will require a slight increase in the length and resistance of the coil to provide the same total magnet area.

As can be seen from the above description of various embodiments of the invention, the principle advantage of the present invention is its compact construction while also allowing for reduced power consumption. The use of very thin magnets and offset yokes help to further reduce power consumption. Center holes and screws or rivets can be used to help facilitate assembly. Use of prewound coils also facilitates assembly and provides for better insulation. Radial slits can also reduce eddy-current losses. The present invention also allows for the use of adhesives with screws or rivets. Straight rods can also be used with magnets for maintaining alignment and diameter accuracy.

Generally, conventional wisdom in the field often states that if the total flux from a permanent magnet is cancelled with a coil, then the permanent magnet will be partially demagnetized and the flux will not return to its previous level when the coil is denergized. This would appear to preclude the practical use of the embodiments shown in the figures since it is necessary to cancel most, if not all of the magnetic flux in order to release the armature and maintain good dynamic performance. However, while the conventional view stated above is true for most permanent magnet materials, it fails to hold for certain classes of commercially available materials such as samarium-cobalt. One such material, CRUCORE 18 a trademark of Crucible Magnetics, has a predominantly linear relationship between applied field and flux density from zero applied field to an applied field of −8.4 kOe. This means that, for this material, an externally applied field can be used to linearly and almost completely reversibly modulate the total flux density in the material from 8.7 kGauss to 0 kGauss, thus satisfying the requirements of the present invention.

A second issue related to the potential demagnetization of the permanent magnet in the magnet-type designs involves the stability of the magnetic properties as a function of temperature. Since coil temperatures in this type of actuator can sometimes exceed 130 degrees C. during operation, it is important the that permanent magnet material not be adversely affected or partially demagnetized by relatively high temperatures. Fortunately, the class of Samarium-Cobalt material described above is capable of operating at temperatures well above 200 degrees C. without significant degradation.

The final practical issue in the magnetic-circuit design of the magnet-type actuator relates to the reluctance of the magnetic path and the number of ampere-turns required in the coil to 'buck' the total magnetic flux. Here again, there is substantial conventional wisdom in the field which states that it is not practical to buck out the total flux from a permanent magnet because the magnetomotive force required would be too large. For this reason, conventional designs generally provide leakage or shunt paths which allow the permanent-magnet flux to continue to flow when the coil is energized; in other words, the coil is used to block the flux from flowing in the primary path through the actuator and to force the flux to pass through z secondary shunting path. This approach is generally motivated by the fact that the magnetomotive force (MMF) required to redirect the permanent-magnet flux is substantially less than the MMF required to completely cancel the flux through the magnet. In the present invention, however, the magnet can be chosen to have a substantially larger cross-sectional area than the pole-face area of the actuator and can, therefore, be relatively thin (on the order of 0.3 mm). This allows the creation of a great many lines of flux to be concentrated at the pole faces, to hold back each armature using a short length of a relatively thin magnet, thus the magnetic reluctance of the permanent magnet is greatly reduced and the MMF required to cancel the permanent magnet flux can be held to a very reasonable level (on the order of 200 Amp-turns).

It should be understood that the foregoing description is only illustrative of the invention. Alternatives and modifications can be devised by those skilled in the art without departing from the spirit of the invention. Accordingly, the present invention is intended to embrace all such alternatives, modifications and variances which fall within the scope of the appended claims.

What is claimed is:

1. A dot matrix printer actuator comprising:

a print armature;

stator means comprising a stator frame having at least two ferromagnetic poles and at least one permanent magnet, said magnet being located between and separating two of said poles, said magnet being magnetized in a line along an axis of said stator means and having a relatively small length, measured between said poles on said axis, and a relatively large combined width and height, measured transversely relative to said axis, said poles each extending transversely from said stator means axis beyond said magnet, said poles each having a magnet contact area, which is an area of contact between said poles and said magnet, and an armature contact area, which is an area of contact between said poles and said armature, wherein the magnet contact area of said poles are relatively larger than the armature contact areas of the poles; and coil means comprising at least one electromagnetic coil having a coil axis perpendicular to its wind which is parallel to said stator means axis and, said coil substantially surrounding said magnet with at least a portion of said coil being located between said poles whereby said magnet can produce a magnetic flux through said poles to hold said armature and, said coil can be energized to counteract the magnetic flux from said magnet such that said armature can move.

2. An actuator as in claim 1 wherein said stator means axis is curved.

3. An actuator as in claim 1 wherein said permanent magnet is formed of samarium-cobalt.

4. An actuator as in claim 1 wherein said stator means further comprises a ferromagnetic offset yoke arranged adjacent said permanent magnet between said poles.

5. An actuator as in claim 1 wherein said stator frame comprises a ferromagnetic slug.

6. An actuator as in claim 1 wherein said stator frame comprises laminated ferromagnetic plates.

7. An actuator as in claim 1 wherein said permanent magnet is fixed to said stator frame.

8. A print actuator comprising:

stator means of ferromagnetic material having a plurality of extending poles along an axis of said stator means and forming coil channels between each of said poles;

magnet means comprising a plurality of permanent magnets, each of said magnets disposed in said stator mans along said stator means axis proximate said co channels and being magnetized along the path of said stator means axis, said magnets being reversed in polarity relative to adjacent magnets and having a relatively small length, measured between said poles on said axis, and a relatively large combined width and height, measured transversely relative to said axis, such that said magnet has substantially larger areas of contact with said poles than said poles armature contact areas;

coil means comprising a plurality of electromagnetic coils, each of said coils having an axis parallel to said stator means axis and substantially surrounding one of said permanent magnets with at least a portion of each of said coils being located in one of said coil channels between a pair of said poles;

armature means comprising a plurality of armatures disposed substantially perpendicular to said stator means axis and each of said armatures extending across one of said boil channels;

means for biasing said armatures away from said poles; and wherein magnetic flux paths from said magnet means extend through alternative poles of said stator means, transversely through the width of each of said armatures in directions parallel to said stator means axis, and through the other of said alternatively poles to hold said armatures in a home position proximate said poles and whereby said coils can be selectively energized to neutralize selective permanent magnet flux paths and allow said biasing means to urge selected armatures into printing engagement.

9. An actuator as in claim 8 wherein said stator axis is circular.

10. An actuator as in claim 8 wherein the actuator is comprised of stator modules.

11. An actuator as in claim 8 wherein said stator means further comprises a plurality of ferromagnetic offset yokes, one offset yoke being arranged adjacent each of said permanent magnets.

12. An actuator as in claim 11 wherein said stator means further comprises a bolt arranged on said stator axis on which said poles, said permanent magnets, and said offset yokes are mounted.

13. An actuator as in claim 11 wherein said poles, said magnets and said offset yokes are bonded together with adhesive.

14. An actuator as in claim 8 wherein said stator means further comprises first and second non-magnetic support plates extending parallel to said stator axis said poles and said magnets being mounted between said support plates.

15. An actuator as in claim 14 wherein each of said poles comprises a stack of ferromagnetic laminations.

16. A method of manufacturing a dot matrix printer actuator comprising the steps of:

providing a ferromagnetic stator having an axis, the stator having a base and a plurality of poles arranged in a line along the stator axis and extending transverse to the axis, said poles having magnet contact areas and armature contact areas;

inserting and bonding permanent magnets into first slots in the stator, the first slots each being arranged along the stator axis between pairs of adjacent poles, the magnets and the slots having a relatively small length, measured between poles on the stator axis, and a relatively large combined width and height, measured transversely relative to the stator axis, such that the magnets have substantially larger actuators pole-face areas of the poles for contacting armatures areas of contact with the poles than the armature contact areas of the poles; and installing coils around the permanent magnets and at least partially in the first slots between adjacent poles.

17. A method as in claim 16 wherein the step of providing a ferromagnetic stator comprises the step of bonding laminations together.

18. A method as in claim 17 further comprising the step of attaching a first support plate to a first surface of the poles and a second support plate to a second surface of the poles.

19. A method as in claim 18 further comprising the step of removing the base from the stator.

* * * * *